US007810950B2

(12) United States Patent
Zhou et al.

(10) Patent No.: US 7,810,950 B2
(45) **Date of Patent: *Oct. 12, 2010**

(54) LED LAMP HAVING A VAPOR CHAMBER FOR DISSIPATING HEAT GENERATED BY LEDS OF THE LED LAMP

(75) Inventors: Zhi-Yong Zhou, Shenzhen (CN); Qiao-Li Ding, Shenzhen (CN)

(73) Assignees: Fu Zhun Precision Industry (Shen Zhen)., Ltd., Shenzhen, Guangdong Province (CN); Foxconn Technologj Co., Ltd., Tu-Cheng, Taipei Hsien (TW)

( * ) Notice: Subject to any disclaimer, the term of this patent is extended or adjusted under 35 U.S.C. 154(b) by 244 days.

This patent is subject to a terminal disclaimer.

(21) Appl. No.: 12/131,111

(22) Filed: Jun. 1, 2008

(65) Prior Publication Data

US 2009/0268476 A1 Oct. 29, 2009

(30) Foreign Application Priority Data

Apr. 23, 2008 (CN) ..... 2008 1 0066777

(51) Int. Cl.
*F21S 4/00* (2006.01)
*F21V 21/00* (2006.01)

(52) U.S. Cl. ..... 362/249.02; 362/294; 362/373

(58) Field of Classification Search ..... 362/249.02, 362/294, 373

See application file for complete search history.

(56) References Cited

U.S. PATENT DOCUMENTS 7,674,011 B2 * 3/2010 Zhou et al. ..... 362/249.02

* cited by examiner

*Primary Examiner*—Stephen F Husar
*Assistant Examiner*—James W Cranson
(74) *Attorney, Agent, or Firm*—Frank R. Niranjan

(57) ABSTRACT

A heat dissipation device includes a heat conductive member, a fin unit coupled to a bottom surface of the heat conductive member and a plurality of LED modules attached to a top surface of the heat conductive member. The heat conductive member consists of a first plate, a second plate parallel to the first plate and a plurality of posts sandwiched between the first and second plates. Peripheries of the first and second plate are in a hermetical conjunction with each other to form a chamber containing a phase-changeable working fluid therein. The first and second plates therein define a plurality of through orifices. The posts each define therein a screwed orifice which is in alignment with corresponding through orifices of the first and second plates respectively and threadedly receives a screw extending through the LED module.

10 Claims, 4 Drawing Sheets

LED LAMP HAVING A VAPOR CHAMBER FOR DISSIPATING HEAT GENERATED BY LEDS OF THE LED LAMP

BACKGROUND OF THE INVENTION

1. Field of the Invention

The present invention relates to an LED lamp and particularly to an LED lamp having a vapor chamber functioning as a heat dissipation device for removing heat from LEDs of the LED lamp.

2. Description of Related Art

The high power LED light devices produce considerable amount of heat, which may cause performance degrade or even damage if the heat is not removed from the LED chips efficiently. In an LED light device, the core is an LED chip mounted on a substrate. A transparent top covering the LED chip serves as a lens for modifying the direction of the emitted light. Although there are many different designs, the major heat dissipation route for the heat produced by the LED chip usually is managed through the base to which the LED chip is mounted or through an additional metal heat sink below the base and then to an outer heat sink.

Traditional adoption of the fans for active cooling system not only introduces noise problems but also brings risk of damage to a LED lamp if the fan is out of order. In contrast, passive cooling with natural convection is quite, continuous and time-unlimited. But since a natural convection system is relative weak for heat dissipation, to solve this problem, a large surface area is needed to enhance heat dissipation capacity. Most passive cooling devices for LED lamps simply use metallic blocks, such as copper or aluminum block with extended fins for heat dissipation. However, the thermal dissipation capacities of these simple metal blocks with extended fins may be still insufficient for dissipating the heat generated from the LED lamps, which results in a relatively high temperature of the LED lamps during operation.

What is needed, therefore, is a heat dissipation device for an LED light device which has an improved heat dissipating structure to thereby overcome the above mentioned disadvantages.

SUMMARY OF THE INVENTION

A heat dissipation device includes a heat conductive member, a fin unit coupled to a bottom surface of the heat conductive member and a plurality of LED modules attached to a top surface of the heat conductive member. The heat conductive member consists of a first plate, a second plate parallel to the first plate and a plurality of posts sandwiched between the first and second plates. Peripheries of the first and second plate are in a hermetical conjunction with each other to form a chamber containing a phase-changeable working fluid in the heat conductive member. The first and second plates define therein a plurality of through orifices. The posts each define therein a screwed orifice which is in alignment with corresponding through orifices of the first and second plates respectively. A screw is used to extend through the LED module and a corresponding through orifice in the first plate to threadedly engage in the screwed orifice of a corresponding post, thereby to tightly secure the LED module to the first plate of the heat conductive member. Accordingly, heat generated by the LED module can be effectively absorbed by the conductive member. The fin unit is thermally connected to the second plate of the heat conductive member.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
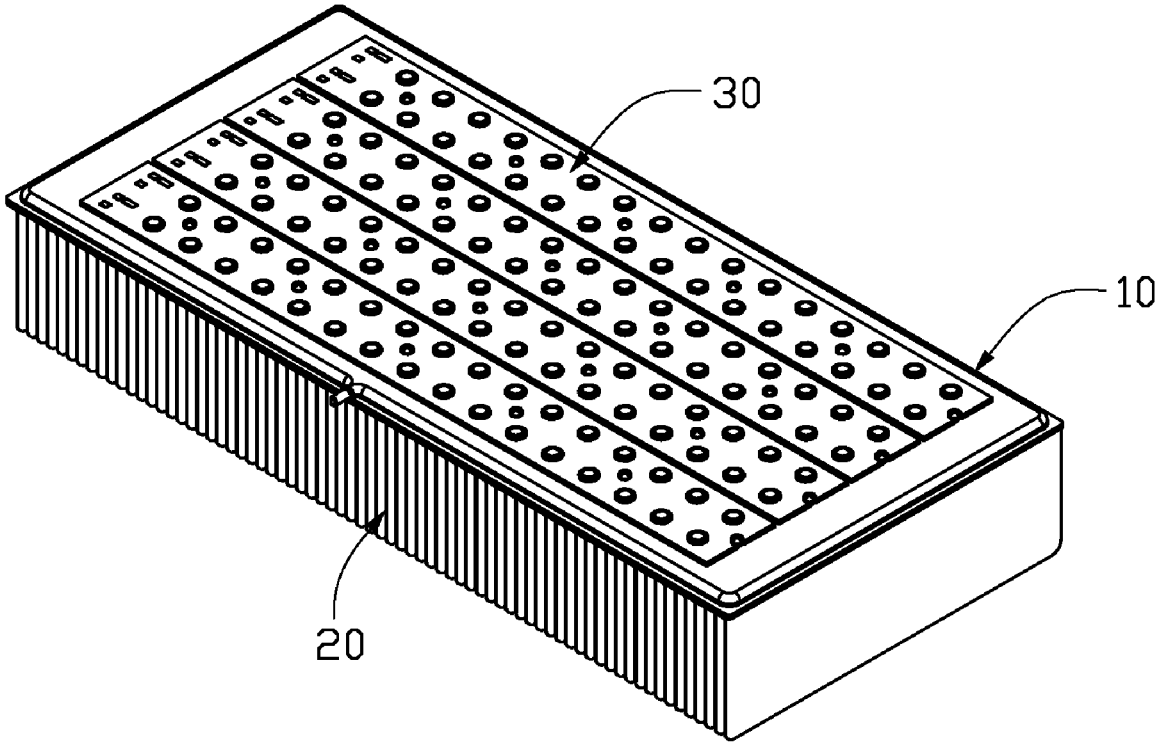
FIG. 1 is an isometric, assembled view of an LED lamp in accordance with a preferred embodiment of the present invention.
Figure 2:
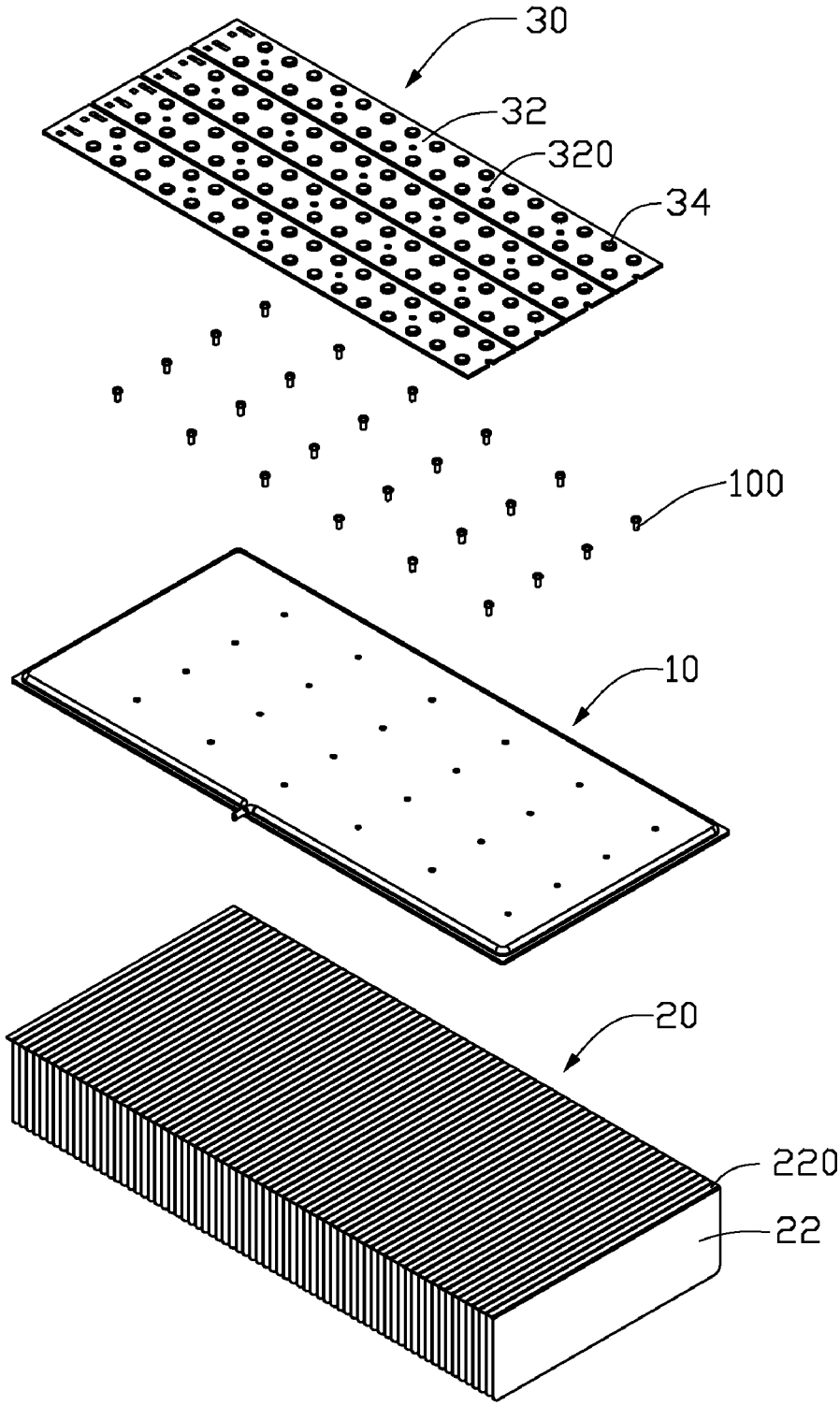
FIG. 2 is an exploded view of FIG. 1.

Referring to FIGS. 1-2, an LED lamp includes a heat dissipation device and a plurality of LED modules 30 mounted on the heat dissipation device. The heat dissipation device comprises a heat conductive member 10, a fin unit 20 coupled to a bottom surface of the heat conductive member 10 and a plurality of LED modules 30 attached to a top surface of the heat conductive member 10.

Figure 3:
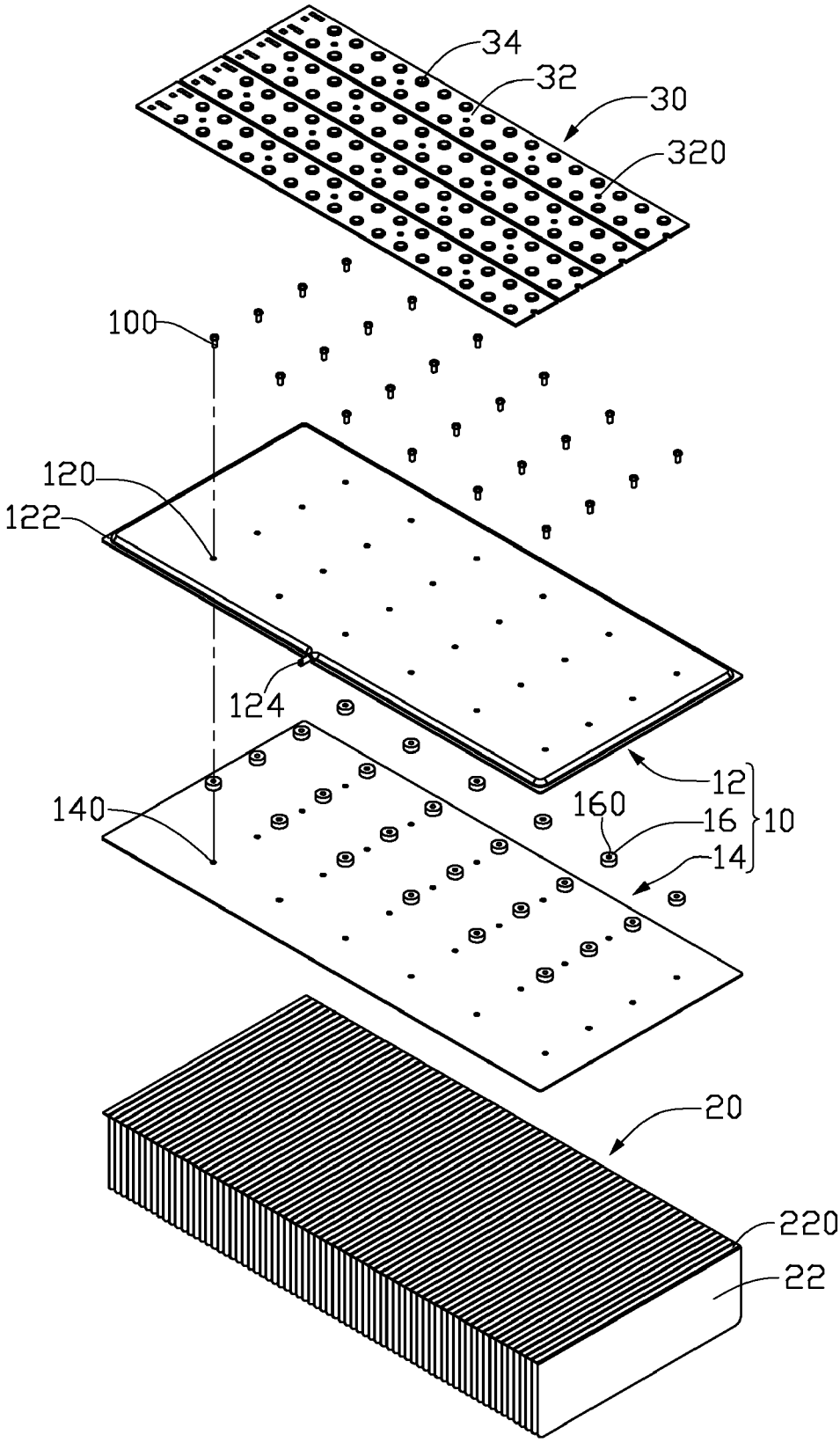
FIG. 3 is a further exploded view of FIG. 2.
Figure 4:
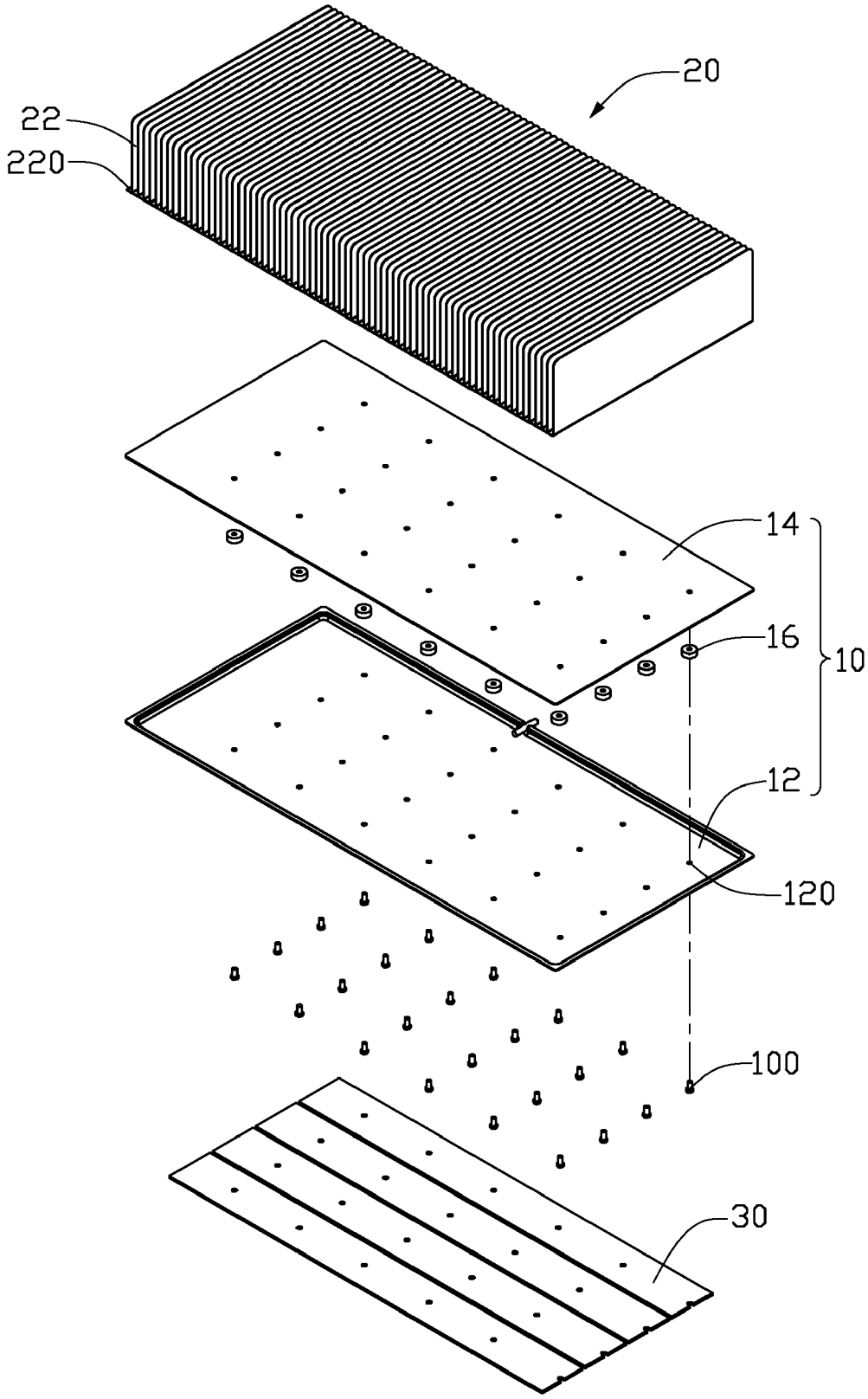
FIG. 4 is an inverted view of the LED lamp in FIG. 3.

Particularly referring to FIGS. 3 and 4, the heat conductive member 10 is a flat-plate type heat pipe (or named as a vapor chamber), functioning as a plate-type heat spreader for quickly absorbing heat produced by the LED modules 30 and transferring the heat to the fin unit 20. The heat conductive member 10 comprises a first plate 12, a second plate 14 incorporating with the first plate 12 to form a sealed chamber (not labeled) and a plurality of posts 16 sandwiched between first and second plates 12, 14 in the sealed chamber. The posts 16 are used to enable the first and second plates 12 to maintain a constant distance therebetween. The first plate 12 is rectangular and defines a plurality of first through orifices 120 therein. The first through orifices 120 are equidistributed in the first plate 12. An engaging flange 122 extends downwardly from a periphery of the first plate 12 and is provided for a hermitical conjunction with a periphery of the second plate 14 by welding. The first plate 12 has a sprue 124 formed in the engaging flange 122, through which the sealed chamber of the heat conductive member 10 is vacuumed and working fluid is injected into the sealed chamber of the heat conductive member 10. The second plate 14 is constructed to fitly engage with the engaging flange 122 of the first plate 12 and defines therein a plurality of second orifices 140 which are equidistributed and in alignment with the first orifices 120 of the first plate 12, respectively. Each of the posts 16 has a flat top surface and a flat bottom surface for being respectively coupled to the first and second plates 12, 14 by welding. Each post 16 defines therein a screwed orifice 160 along an axis thereof.

In assembly of the heat conductive member 10, the second plate 14 is combined with the first plate 12. Two opposite top and bottom flat surfaces of each of the posts 16 are hermitically coupled to a bottom surface of the first plate 12 and a top surface of the second plate 14. Each of the screwed orifices 160 of the posts 16 communicates and is in alignment with a corresponding first through orifice 120 of the first plate 12 and a corresponding second orifice 140 of the second plate 14; therefore, the first and second through orifices 120, 140 and the screwed orifices 160 of the posts 16 cooperatively form engaging orifices (not labeled) for threadedly receiving screws 100 therein.

The fin unit 20 is formed from a plurality of fins 22 stacked together. Each of the fins 22 has a flange 220 extending perpendicularly from an upper edge thereof. All of the flanges 220 are arranged in successive to form a flat contacting plane which is attached to the bottom surface of the heat conductive member 10 by a conventional means such as soldering or adhering.

Each of the LED modules 30 comprises an elongated strip-shaped printed circuit board 32 and a plurality of LEDs 34 mounted on the printed circuit board 32. The printed circuit board 32 defines therein a plurality of fixing orifices 320 which is arranged in a line and in alignment with a corresponding row of the through orifices 120 of the first plate 12. The fixing holes 320 are provided for allowing the screws 100 to extend downwardly therethrough to engage into the engaging orifices of the heat conductive member 10. The LED modules 30 are closely juxtaposed on the top surface of the heat conductive member 10.

In assembly of the heat dissipation device, the fin unit 20 is attached to the bottom surface of the heat conductive member 10 by soldering. The LED modules 30 are tightly attached to the top surface of the heat conductive member 10 by extending the screws 100 through the fixing orifices 320 of the LED modules 30 to threadedly engage in the engaging orifices of the heat conductive member 10. Specifically, the screws 100 threadedly engage in the screwed orifices 160 of the posts 16.

In use of the heat dissipation device, heat generated from the LED modules 30 is directly adsorbed by the heat conductive member 10 and timely delivered to the fin unit 20 via the heat conductive member 10 to dissipate into ambient air. In addition to spacing the first and second plates 12, 14, the posts 16 sandwiched between the first plate 12 and the second plate 14 of the heat conductive member 10 can reinforce the heat conductive member 10 to resist an upward or downward pressure on the first or second plate 12, 14, and facilitate an intimate attachment of the LED modules 30 onto the heat conductive member 10 more conveniently.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat conductive member comprising a first plate, a second plate parallel to the first plate and a plurality of posts sandwiched between the first and second plates;

a fin unit coupled to a bottom surface of the heat conductive member; and a plurality of LED modules attached to a top surface of the heat conductive member; wherein peripheries of the first and second plates are in a hermetical conjunction with each other to form a chamber containing a phase-changeable working fluid therein, the first and second plates define therein a plurality of through orifices, the posts each define therein a screwed orifice which is in alignment with corresponding through orifices of the first and second plates respectively and threadedly receives a screw extending through the LED module.

2. The LED lamp of claim 1, wherein the first plate is rectangular and has an engaging flange which extends downwardly from a periphery of the first plate and hermitically engages with a periphery of the second plate by soldering.

3. The LED lamp of claim 1, wherein the through orifices of the first plate are equidistributed in the first plate.

4. The LED lamp of claim 1, wherein the fin unit comprises a plurality of fins each of which has a flange extending perpendicularly from a top edge thereof and attached to the bottom surface of the heat conductive member.

5. An LED lamp comprising:

a heat conductive member defines a plurality of engaging orifices therein;

a fin unit coupled to a bottom surface of the heat conductive member; and a plurality of LED modules mounted on a top of the heat conductive member by screws extending downwardly therethrough to engage into the engaging orifices of the heat conductive member, wherein the heat conductive member defines a sealed chamber receiving a phase-changeable working fluid and a plurality of spacing posts therein, each post defining a screwed orifice forming a part of a corresponding engaging orifice.

6. The LED lamp of claim 5, wherein the first and second plates define therein a plurality of through orifices in alignment and cooperating with corresponding screwed orifices to form the engaging orifice.

7. The LED lamp of claim 5, wherein peripheries of the first and second plate are in a hermetical conjunction with each other to form the sealed chamber containing phase-changeable working fluid therein.

8. The LED lamp of claim 7, wherein the first plate is rectangular and has an engaging flange which extends downwardly from the periphery of the first plate and hermitically engages with the periphery of the second plate by welding.

9. The LED lamp of claim 6, wherein the through orifices of the first plate are equidistributed in the first plate.

10. The LED lamp of claim 5, wherein the fin unit comprises a plurality of fins each of which has a flange extending perpendicularly from a top edge thereof and attached to the bottom surface of the heat conductive member.

* * * * *